US006546436B1

(12) United States Patent
Fainmesser et al.

(10) Patent No.: US 6,546,436 B1
(45) Date of Patent: Apr. 8, 2003

(54) SYSTEM AND INTERFACE FOR CONTROLLING PROGRAMMABLE TOYS

(76) Inventors: Moshe Fainmesser, 6/5 Rachel Hameshoreret, Raanana (IL); Nira Krumholtz, 6/5 Rachel Hameshoreret, Raanana (IL); Eran More, Ben Yosef 10, Tel Aviv (IL)

( * ) Notice: Subject to any disclaimer, the term of this patent is extended or adjusted under 35 U.S.C. 154(b) by 0 days.

(21) Appl. No.: 09/281,409

(22) Filed: Mar. 30, 1999

(51) Int. Cl.[7] ..... G06F 13/14

(52) U.S. Cl. ..... 710/5; 345/156; 345/339; 345/473; 446/175

(58) Field of Search ..... 710/5, 15; 345/156, 345/339, 473; 446/175

(56) References Cited

U.S. PATENT DOCUMENTS 4,712,184 A 12/1987 Haugerud
4,840,602 A * 6/1989 Rose ..... 446/175
5,142,803 A * 9/1992 Lang ..... 40/411
5,182,557 A * 1/1993 Lang ..... 341/20
5,191,615 A * 3/1993 Aldava et al. ..... 381/2
5,289,273 A * 2/1994 Lang ..... 348/121
5,697,829 A 12/1997 Chainani et al.
5,724,074 A 3/1998 Chainani et al.
5,746,602 A * 5/1998 Kikinis ..... 434/169
5,977,951 A * 11/1999 Danieli et al. ..... 345/156
6,038,493 A * 3/2000 Tow ..... 700/259
6,121,981 A * 9/2000 Trower, II et al. ..... 345/473
6,181,351 B1 * 1/2001 Merrill et al. ..... 345/473
6,246,927 B1 * 6/2001 Dratman ..... 700/243
6,290,565 B1 * 9/2001 Galyean, III et al. ..... 446/99
6,290,566 B1 * 9/2001 Gabai et al. ..... 446/175

OTHER PUBLICATIONS

Promotional Material describing first generation toy interface from Phantom II Production Ltd., Nov., 1989.
Printouts from Web Site "www.phantom2.com" dated 1996.
Printout from Web Site "www.lego.com/dacta/robolab/rcx.htm" dated Feb. 9, 1999.

* cited by examiner

*Primary Examiner*—Jeffrey Gaffin
*Assistant Examiner*—Abdelmoniem Elamin

(57) ABSTRACT

A programmable toy interface for electrical connection with and control of a toy structure having at least one electrically-powered output device, such as a motor, light or sound output, and that is adapted to communicate with a computer having a programmable toy control and identification program is provided. The interface includes a memory having an identification code, an RF modem adapted to receive command and identification code signals from at least the computer and for transmitting data to at least one of the computer and a second interface, a controller in communication with the memory and the modem, adapted to process data stored in the memory for transmission via the modem; and a power supply that supplies electrical power to the controller. A system including one or more such computers and one or more such interfaces is provided whereby multiple interfaces can communicate with each other and multiple computers can transmit data at the same RF frequency without interference from one another.

40 Claims, 7 Drawing Sheets

SYSTEM AND INTERFACE FOR CONTROLLING PROGRAMMABLE TOYS

FIELD OF THE INVENTION

This invention relates to the field of programmable devices for entertainment and educational purposes, and more particularly to toy systems having programmable interfaces that communicate with and are controlled by personal computers or by other interfaces.

BACKGROUND OF THE INVENTION

Computer-controlled, programmable robotic, or other electrically-powered, toy systems have existed for several years. One example of such a system is a programmable toy construction robot having one or more electrically-powered output components such as motors for driving wheels, arms, and clamps, visual outputs such as lights, and/or audio outputs such as sirens and music. Early systems typically operated only in an open-loop mode (without sensory feedback), and were programmable to permit simple move/stop or on/off commands. Further, programming the output commands were fairly complex as the child had to know or learn how to program source code in languages such as "Basic," "C," and the like. These factors limited the target audience for these toy systems to adolescent children and young adults.

Nevertheless, technological advances, such as improvements in computer processing power and speed, the increasing availability of user-friendly, icon-based, programming, and the dramatic reductions in the size and cost of components have led to programmable toy systems that are appropriate for a wider range of users. Specifically, these systems have become (1) more controllable or "smarter" and, thus, (2) more fun for the user, (3) easier to program, even for a young child, and (4) important educational tools (e.g., by teaching and sharpening a wide range of skills, including, problem-solving, logic, electro-mechanical design, and computer programming). Further, the personal computers ("PC") needed to program the toy systems have become widely available to children of all ages in the home and school enviroments.

A schematic example of a conventional programmable robotic toy system is shown in FIG. 1. The system 10 includes a PC 12, a programmable toy unit 16 and a communications link 18 for enabling communication from the PC 12 to the toy unit 16. The programmable toy unit 16 has two primary components, namely, a toy structure, or model, 20, and a programmable interface, or controller, 22. The toy structure 20 is often a model, such as a robot or automobile that is assembled by the child from smaller components in a construction kit or from blocks or "bricks," either with instructions or designed completely by the child. Alternatively, the toy may require no assembly, as it may be purchased pre-assembled or is of generally unitary construction. The toy structure also includes one or more electrically-powered components that affect some action, such as a motor for moving a robotic arm, a light or lamp for providing visual effect, or a buzzer, siren or other audio generator. In the present example, the electrically-powered component is a motor 23 for driving the wheels of the toy structure 20. More sophisticated toy structures also include detectors, or sensors (not shown). The sensors monitor the toy's environment for processing by the controller and for affecting the action of theelectrically powered components, thereby creating sophisticated closed-loop operation. Light, temperature, touch, angle and rotation detectors are a few examples of such sensors.

The conventional interface, or controller 22, is a separate device that connects to the toy assembly and includes a microcontroller 24, a memory 26 that, among other functions, stores one or more control programs, a power supply 28 for powering the controller components and the toy's electrically-powered components, a communications port 30 for connecting the interface to the PC 12 through the communication link 18, and an output strip 32, having one or more power outputs, that are connectable to the toy's power components. Input sensors on the toy structures connect to inputs (not shown) on the interface 22. conventional, high-level programming language, such as Basic or "C," that requires significant programming knowledge to create control programs for the toy. Newer systems implement graphical, or iconbased, "programmer programs" that enable even young children to create logic-based control programs by simply selecting icons displayed on the computer screen that correspond to executable functions (both input and output) for the toy. The PC converts the graphical program into a control program that is executable by the toy's controller 22. After the user programs the control program on the PC 12 via a keyboard, it is transmitted, or downloaded, to the memory 26 of the toy interface 22 for execution upon controller's receipt of the appropriate signal.

There are generally two broad categories of transmission systems, namely, wired and wireless modem, the latter including infrared and radio frequency transmission. In the wired mode, the communications link 18 either remains tethered to the toy unit 16, thereby limiting its range of operation from the PC, or is disconnected after program download for remote operation of the toy.

While such systems have become reasonably popular with a certain segment of the children's toy market, they have drawbacks. First, the young programmer/player of these toy systems does not have as much control over the operation of the toy unit as is desirable. In particular, the role of the computer 12 is limited to creating and downloading one or more programs to the toy's interface 22. Once done, the PC 12 and control software 14 typically play no further role until one wishes to program and download a new program to the toy unit. Thus, after programming is completed, the operator is not really a player. Instead, he or she merely plays the passive role of watching the toy unit execute the program in either open-loop or closed-loop (sensor) mode. Thus, it would be desirable to have a programmable toy that is relatively interactive for individuals playing with it.

Further, existing systems are primarily designed for programming and controlling a single toy. In other words, while one PC and its control software can be used to program more than one toy unit, the toys cannot communicate or interact with each other. Each downloaded toy operates completely independently of any others.

A further drawback to existing systems is that their programmable interfaces are designed to operate only with one particular line, or make, of toys. It would thus be desirable to have an interface that can operate with a wide range of manufacturers' programmable toy structures, each having different electrical requirements for its input and output components.

SUMMARY OF THE INVENTION

The present invention, which addresses these needs, resides in a programmable toy interface that connects to a toy structure and a system for programming and controlling one or more controllable toys. The invention described below has a number of advantages, including: (a) it is designed to be operated either as a single toy unit or as a system of toys that interact with each other; (b) it provides the ability to program a unique identification code for each toy unit within a group of toys; (c) it keeps the programming computer relevant to the operation of the toy unit or system of toys even after the toy units have been programmed; (d) it permits multiple modes of controlling one or more toys; (e) it enables multiple program and control computers to operate at substantially the same time in a single room without interference with one another; and (f) it opens up the field of programmable toys to interactive team play.

In accordance with the present invention, the programmable toy interface electrically connects with and controls a toy structure having at least one electrically-powered output device, such as a motor, light or sound output. The interface is adapted to communicate with a computer loaded with a programmable toy control and identification program. The interface includes a memory having an identification data portion that stores user-definable identification data, a toy controller that executes the toy control program, and a power supply that supplies electrical power to the controller.

The user-definable identification data, or code, stored in the memory of the interface enables the computer or any other interface to communicate with it to the exclusion of other interfaces. If desired, a programmer can define a unique ID code for the interface or to each interface in a collection of toy units so that each can be distinguished from the other.

In one aspect of the invention, the interface further includes a transceiver for receiving signals from at least the computer and for transmitting the signals to either the memory for storage or to the controller for processing. In a more detailed aspect, the transceiver is a Radio Frequency (RF) modem. The transceiver can also receive data from and transmit data to one or more other interfaces having like transceivers. This feature, together with the unique ID code feature, advantageously permits many toys to remotely communicate with and control each other. For example, a first toy unit can remotely download a control program resident in its interface memory to a second toy unit's programmable interface for direct "online" action or for storing in its memory. Further, the user-definable identification data may be supplied by a second programmable interface connected to another toy structure. The interface is further adapted to communicate with one or more like interfaces having user-definable ID codes by addressing those ID codes.

In more detailed aspects of the present invention, the memory of the interface further includes a program memory portion for storing therein at least one program or command for processing by the controller. The interface may also include at least one input and input circuitry for electrically connecting thereto an input device connected to the toy structure. The input device may be a sensor or detector, such as a light, sound, touch, rotation, pressure or other sensor. Further, the power supply may be adapted to selectively supply electric power to the output device of the toy structure in response to a signal from the controller. Alternatively, the power for the output device may reside with the toy structure itself. In this embodiment, the interface would merely supply electrical control signals to the power supply in order to direct it to output the appropriate power to the output device.

In yet another aspect of the invention, the interface is capable of operating with a wide range of toy structures having different power input and output requirements. In particular, the interface is designed to output direct current (DC) voltage in a range of approximately 3–12 volts while the reading input signals from a wide variety of analog or digital input sensors rated at 0–7 volts DC.

According to another aspect of the invention, a PC-based, programmable, toy entertainment system includes a first computer loaded with a control, program-development program which generates control and command signals and user-definable identification data, and a first addressable toy unit adapted to communicate with the computer. The toy unit includes a first programmable toy interface and a toy structure, such as a robot or car. The first interface includes a transceiver for communicating with the computer, a controller that executes the control and command signals, a memory configured to store the user-definable identification data, a power supply that supplies electrical power to the controller and transceiver, and at least one electric power-supplying, output port. The first toy structure electrically connects to the interface and is capable of producing, in response to the least one output signal from the interface, at least one controlled electric power output, such as motion, light or sound.

The toy control, program-development, software program loaded on to the computer is adapted to produce control and command signals and programs for controlling, programming and communicating with the toy interface. It also produces the user-definable identification data that is transmitted to and stored by each of the at least one addressable toys.

In a more detailed aspect of the invention, the system includes a communications link, or transceiver, which may or may not be wireless. The wireless embodiment is preferably a radio frequency (RF) communications link, but may be another communications means such as an infrared transmission link. The link transmits the user-definable identification code and the control commands from the computer to the interface and from the interface to the computer.

In yet a further embodiment, the system further includes a second programmable toy unit with a second programmable toy interface having a second interface transceiver and that is adapted to communicate with the first interface and the first computer. Alternatively, the system further includes a second computer loaded with a toy control, program-development, software program and adapted to output control and command signals and programs for controlling, programming and communicating with the first toy interface and for producing a user-definable identification data for transmission to and storage by the addressable toy unit. The first and second computers are adapted to communicate RF commands without interference from each other, by waiting until the waves in the vicinity of the units are void of RF transmissions prior to transmission.

Other features and advantages of the present invention should become more apparent from the following description of the preferred embodiments, taken in conjunction with the accompanying drawings, which illustrate, by way of example, the principles of the invention.

DETAILED DESCRIPTION OF THE PREFERRED EMBODIMENTS

The invention summarized above and defined by the enumerated claims may be better understood by referring to the following detailed description, which should be read in conjunction with the accompanying drawings. This detailed description of particular preferred embodiments, set out below to enable one to build and use particular implementations of the invention, is not intended to limit the enumerated claims, but to serve as a particular examples thereof. The particular examples set out below are the preferred specific implementations of an improved programable toy interface controller and programmable toy system. The description also sets out below preferred implementations for communicating control information to and from a computer and to and from one toy unit to one or more other toy units.

Figure 1:
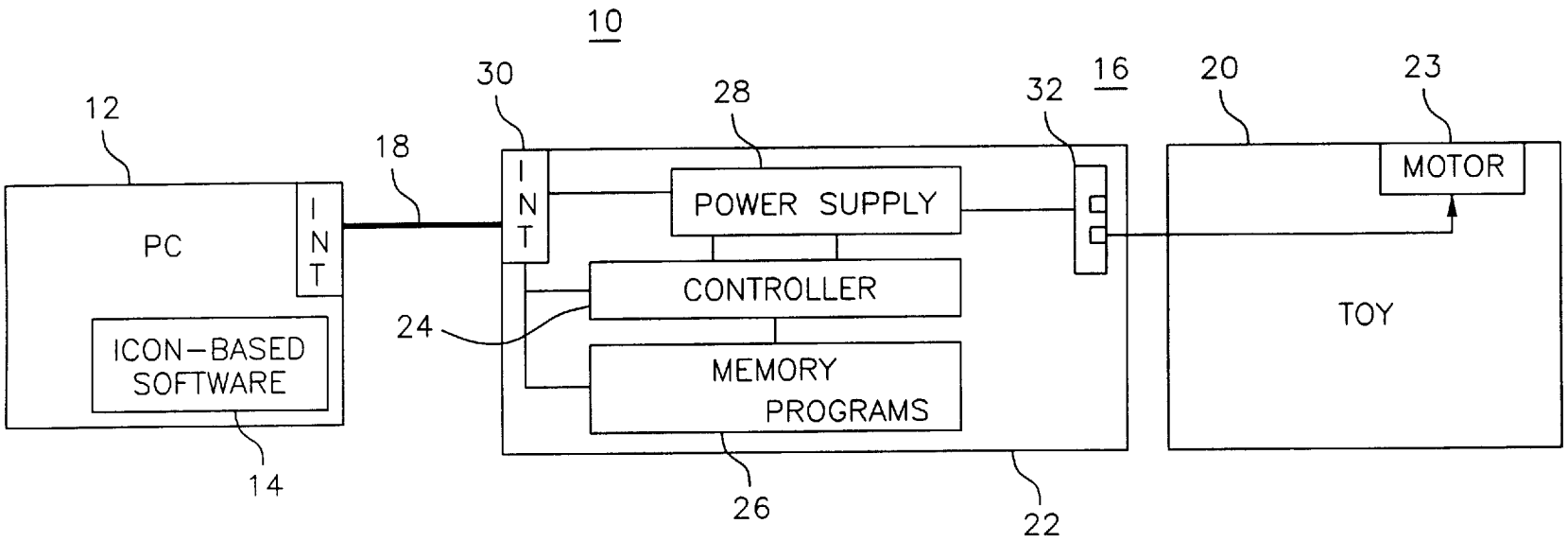
FIG. 1 PRIOR ART
FIG. 1 is an illustrative block diagram of a conventional, computer-controlled, toy robot system.
Figure 2:
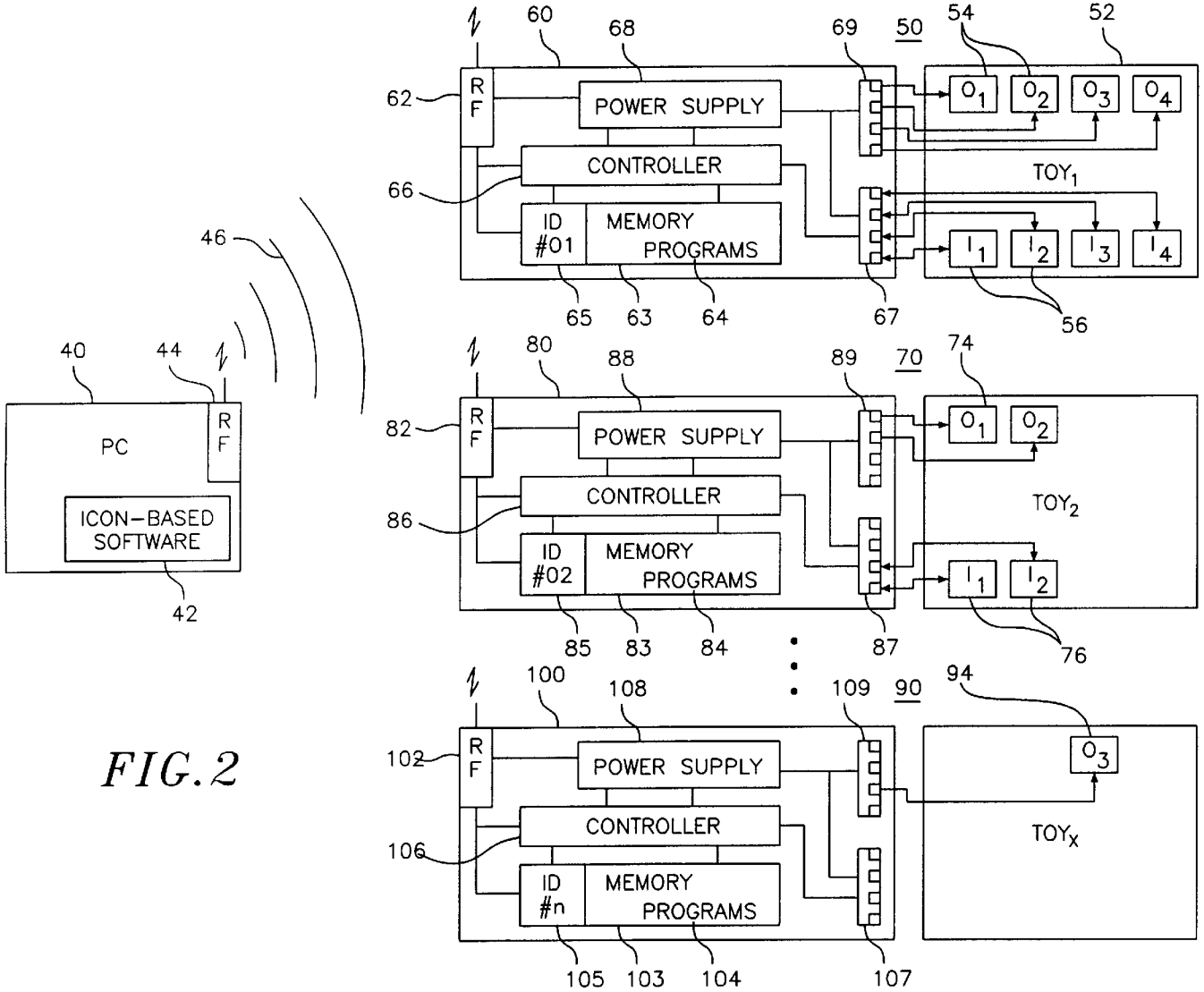
FIG. 2 is a block diagram showing one preferred embodiment of the present invention, wherein each toy unit is associated with its own identification code.

FIG. 2 illustrates the primary components of one preferred embodiment of the present inventive programmable toy system. In particular, a computer 40 is loaded with a graphical user interface program 42 that enables the programmer to create toy control programs and assign toy identification codes, as is described further with reference to FIG. 3. In the preferred embodiment, the control programs and identification codes are transmitted remotely to toy units 50, 70 and 90 via air waves 46 from transceiver 44. It should be understood that the transceiver, as used herein, include a broad range of devices capable of remote transmission and reception including, for example, an RF modem, or an infrared modem. It should be further understood that other conventional means of communicating the program and identification data from the computer to the one or more toy units and from the toy units to the computer, may be used, such as with a wired connection, and are included in the term "transceiver".

Each toy unit 50, 70 and 90 includes a toy structure, or "TOY" 52, 72, 92 and a programmable interface 60, 80, 100, respectively. It should be understood that, in theory, any number of toy units, from 1 to "x" units, may be programmed and controlled by one or more computers. For purposes of illustration and discussion only, "x" in FIG. 2 equals three. Each TOY 52, 72, 92 includes at least one electrically-powered output device, O, e.g., 54, 74, and 94, and optionally includes input devices or sensors, I. In the example shown, $TOY_1$ has four output devices, O1, O2, O3, and O4, corresponding to, for example, two motors, an output light and a siren, respectively. Further, $TOY_1$ has four input sensors I1, I2, I3 and I4, corresponding to, for example, a light sensor, pressure sensor, heat sensor and motion sensor.

Each programmable interface 60, 80, 100 includes four primary components, namely, an RF modem 62, 82, 102, a memory 63, 83, 103, a controller 66, 86, 106 and a power supply 68, 88, 108. Each interface also includes several peripheral circuits, such as, reset circuitry, voltage adaptor circuitry, and battery charger circuitry that are not discussed herein, but are well-known to those skilled in the art. Further, in the preferred embodiment, each interface is designed with four input sockets, collectively denoted as port 67, 87, 107 for connecting thereto a maximum of four sensors, and four output sockets, denoted as port 69, 89, 109 for connecting thereto a maximum of four electrically-powered outputs. It should be understood that the number of input and output sockets is not limited to four, but is merely a matter of design choice.

Figure 3:
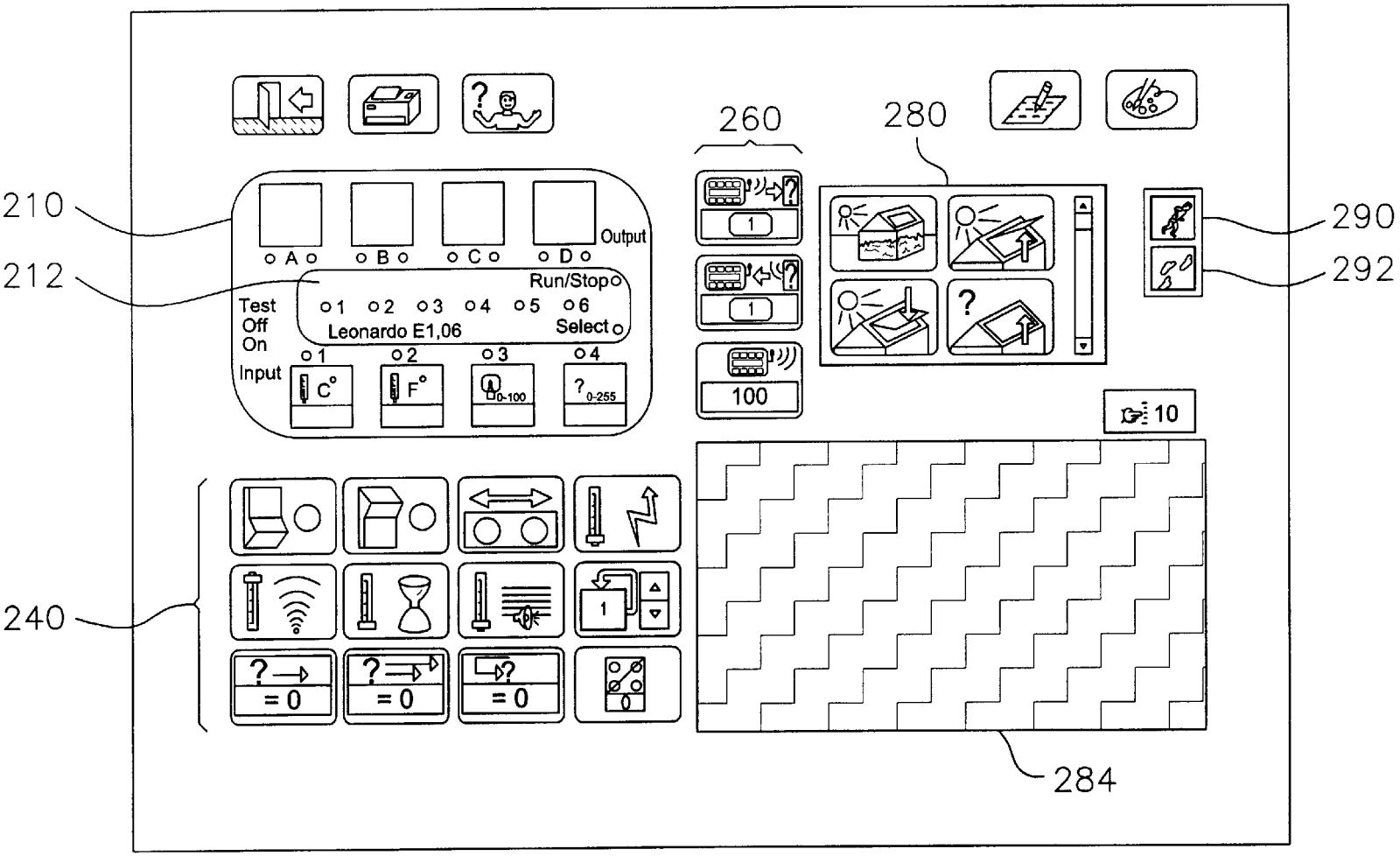
FIG. 3 is a frontal view of a depiction of the icon-based programming program screen of the control software of the present invention.

The following discussion focuses on the four primary components of the upper toy interface 60 in FIG. 2 and applies equally to the other interfaces 80 and I 00 shown in FIG. 2 and to any other interfaces in any given toy system. The memory 63 of the interface 60 is preferably non-volatile and includes a first memory location 64 for storing the control programs and a second memory location 65 for storing an identification ("ID") code to identify the particular toy unit. In the preferred embodiment, the ID code can be any two digit code ranging from 1 to 99, but may be designed for a different range of codes. Each interface comes preset with an ID code, for example, 01. However, the ID code is also user-programmable, that is, it may be repeatedly reset by the programmer via the icon-based program as shown in FIG. 3 and discussed below. In this way, one may program up to 99 unique ID codes for different toy units. The implications and advantages of this novel feature will be further discussed with reference to FIG. 6.

The RF modem 62 is the preferred mode of communication on the interface through which the ID code information and the control programs are received and through which the toy unit 50 can transmit information to other toy units. In the preferred embodiment, the modem circuit includes a Motorola No. 68HC705KJ1 RF chip and an approximately 10-meter RF receiver/transmitter. This modem transmits a Pulse Width Modulated Radio Frequency (PWM-RF), serial signal at approximately 9600 baud. In operation, for example, at an initial setup stage, the toy unit 50 would be activated (turned on) and placed in range of the transmitting computer system 40, which has been programmed by the user to set the ID number of the toy unit before it with the number 01. The computer then transmits (actually, broadcasts) via its modem 44 that ID number, which is picked up by the RF modem 62 and is sent to and stored in the second memory location 65. The computer may concurrently, or later, transmit to the interface 60 a set of control instructions (the program). Other means for communicating between an interface and the PC or between an interface to one or more other interfaces, including infrared and hard wiring, are also possible.

A fundamental feature of the interface 60 is the controller 66, which is presently a Motorola 68HC705C8A microcontroller but may be any appropriate processor. It processes and routes all of the bidirectional data (to the toy unit from the computer or other interfaces and vice versa) via the RF modem 62, and the input data from the toy input sensors, if any, and runs and manages the control programs (in memory 63 or from the computer) to control the power output (e.g. current and voltage magnitude and frequency) from the power supply 68 to the various output devices, O. The power supply 68 is a DC supply which may either be converted from AC or is battery-powered, or, in the preferred embodiment, is a bank of batteries with optional AC to DC conversion. In addition to powering the output devices, O, through the output ports 69, the power supply also supplies power to the controller 86, the various circuits in the interface 60, and to any input devices that may be connected to the interface via its input port 67.

Figure 4:
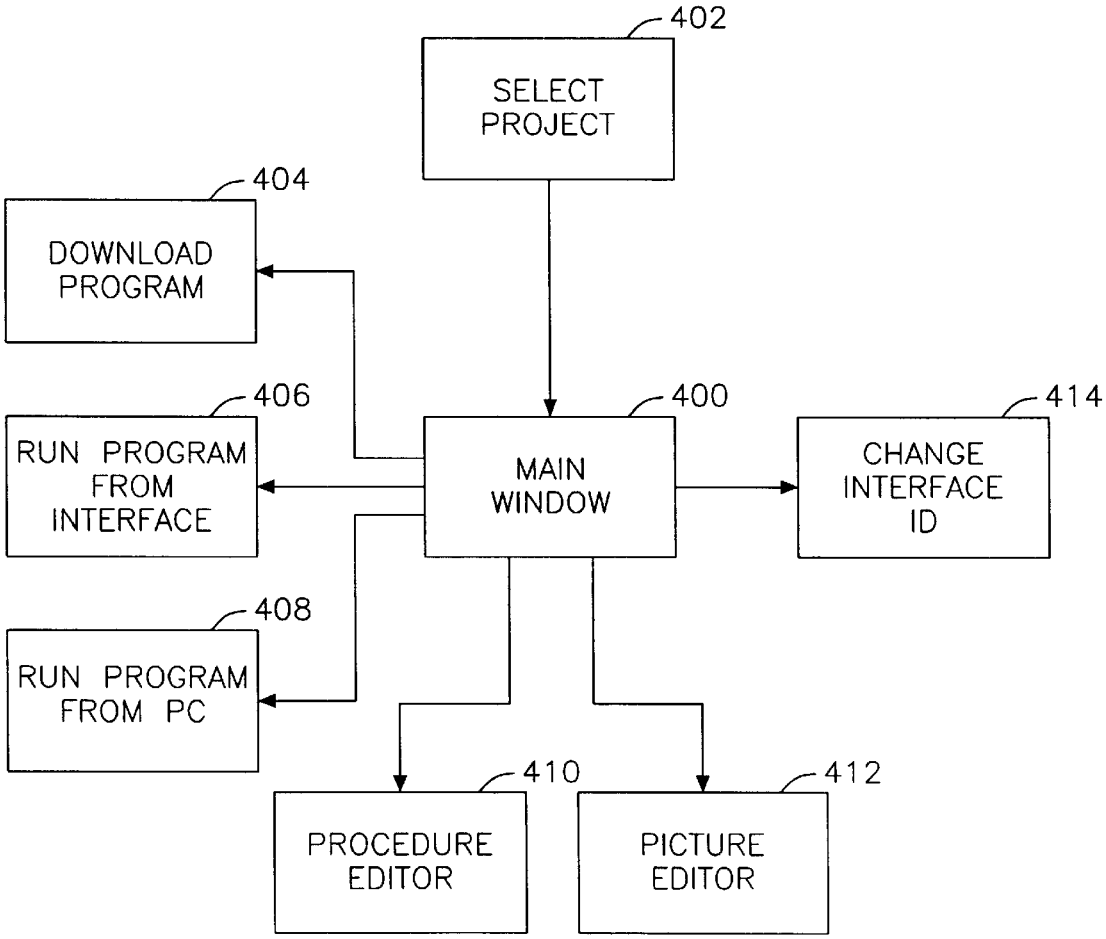
FIG. 4 is a flow chart that describes the main modules of the control software of the present invention.

In the preferred embodiment, and as described with reference to FIG. 4, there are three basic modes of transmission of a control program from the computer 40 to the toy unit 50.

In one mode, the program is downloaded to the memory 63 (the first memory location 64 for storing programs) for use and execution by the controller 66 at a later time. In a second mode, the control program data is transmitted to the interface modem 62 and is immediately executed by the controller 66 for "online" action. Thus, the computer retains control of the operation of the toy. In a third mode of operation, the programmer transmits to the appropriate interface one control step of the program (in the form of a control icon) for instance, a move command, per mouse click, thereby effecting step-by-step execution. This mode enables the user/programmer to track how the toy unit responds to each step of a given program.

As further shown in the figure, interfaces 80 and 100 are similarly connected to their toy units 72 and 92, respectively, depending on the number of output, O, and input, I, devices used by the toy structure. Further, each interface may be mechanically connected to its corresponding toy unit, may be placed on or in it, or may merely be electrically connected to it via its I/O ports.

FIG. 3 is a representation of the icon-based programming screen that is displayed on a computer screen, and that is used by the operator of the present inventive system to create control programs for the controllable toy unit and for actually controlling the toy unit. As is well known in Microsoft Windows® and Apple Macintosh® based operating systems, the programmer merely points the screen cursor over the icon of interest and clicks on it to highlight and execute the operation it represents. This is the preferred method of creating the control programs used by the toy units of the present invention, as icon-based programming is simple, intuitive and requires no prior programming experience. The screen includes a graphic representation of an interface 210 with a group six LEDs 212 representative of the six distinct programs that are storable in the first memories 64, 84 and 104 of each interface. The interface icon 210 also displays an image of four selectable inputs 1, 2, 3 and 4 corresponding to the four input sockets on the interface that are connectable to sensors on a remote TOY, and four selectable outputs, A, B, C, and D that correspond to the four usable sockets that are connectable to electrically powered outputs of a remote TOY. Icon group 240 shows the various programming steps that are programmable, including, for example, start/stop commands, conditional commands (if-then; if-then-else), and controlled output-power levels and on time commands. Icon group 260 is the identification/communication and command icon group that controls how the computer identifies the interface and how the interface communicates with the computer and with other interfaces. In particular, the top icon is a "send" command to the TOY(s) having a particular ID code. The middle icon is the "get" data from a TOY having a particular ID code. The bottom icon is the "send-to-all" or "broadcast" icon, whereby a single command or a control program is sent to all interfaces within range of the computer's modem.

Each icon in Icon group 280 represents a selectable preprogrammed control program that is stored in the computer. Area 284 is a picture screen that shows a drawing representative of a particular program. Finally, the alternative control methods for downloading and executing control programs, namely online running of a program and step-by-step programming, are controlled by selecting by icons 290 and 292, respectively.

The broad structure of the control program of the present invention is now described with reference to the chart shown in FIG. 4. The chart assumes that one or more programs have already been programmed or pre-loaded in the computer. In particular, from the main window 400 (corresponding to FIG. 3), the user selects aprogram or "project," 402 (from icon group 280) to either (a) be edited by procedure editor 410 (to edit the selected program) or picture editor 412 (which is a merely "paint" type program that permits the program icons to be edited by the user); or (b) communicate with an interface. For the latter function, from the main window 400, the user has numerous options. The user can elect to download the selected program to an interface via module 404, run the selected program from the selected interface (whose memory, of course, has already been loaded with one or more programs) via module 406, or run the selected program from the computer itself via module 408. Additionally, the user may change the interface ID from the main window 400 via module 414.

Figure 5A:
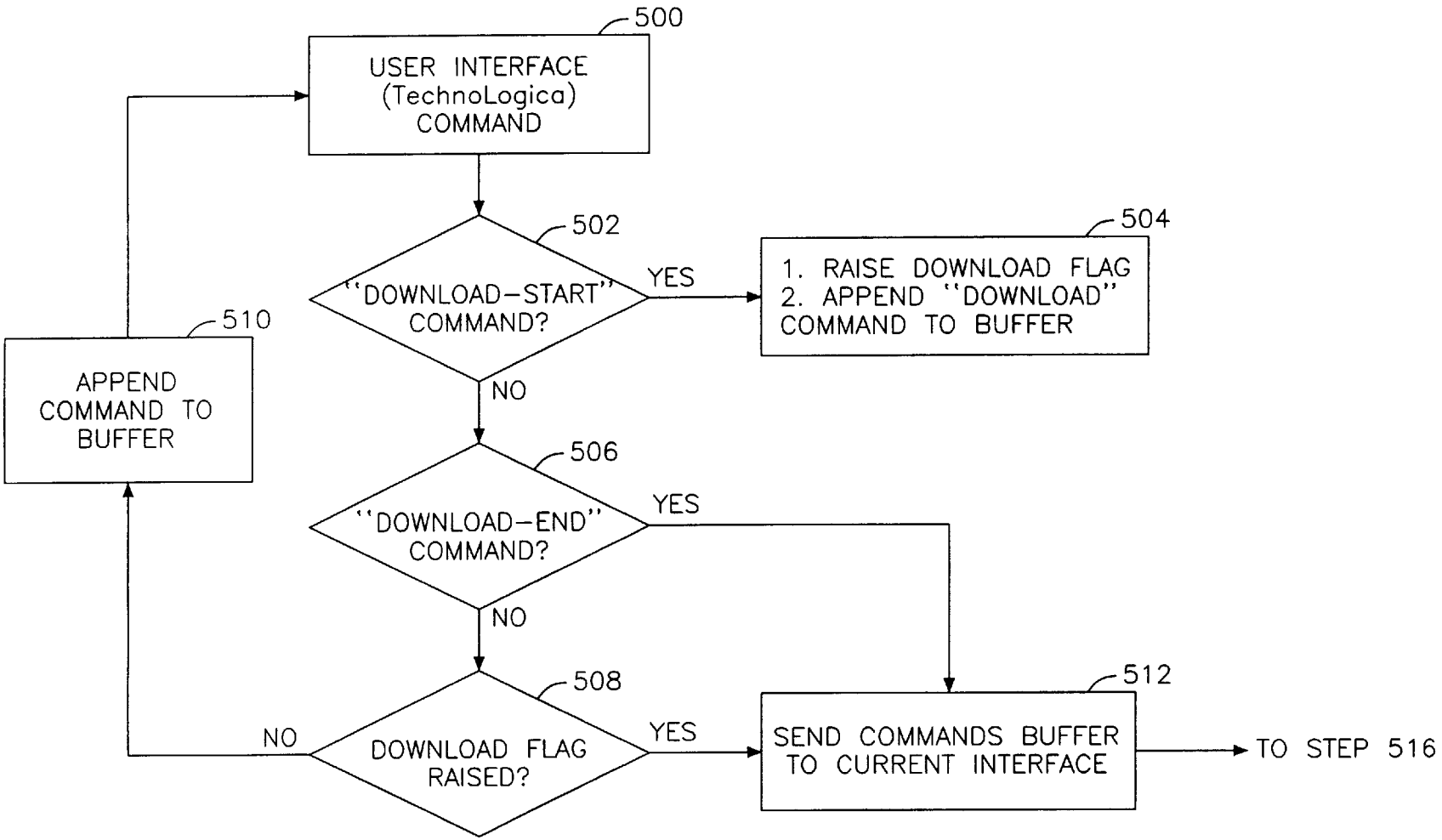
FIG. 5*a* is a flow chart depicting the method used by computer software of the present invention to prepare command strings prior to sending the command to a specific interface.

The communication procedure between the computer and an interface comprises two steps, namely, a) preparing, or building, a command string into a buffer to be transmitted to an interface; and then 2) actually transmitting this information to the interface. These two steps are described with reference to FIGS. 5*a* and 5*b*, respectively. The flow charts assume that a command or program has already been prepared and is ready for sending to an interface. Referring now to FIG. 5*a*, in step 500, the user selects a command via the graphical user interface program. In step 502, the system determines whether this command is a "download-start" command. This is the command that determines whether the data to be sent to the interface will operate in the download and store-in-interface-memory mode. If it is, the system, in step 504, appends a "download" command byte to the internal buffer, raises (sets) a "Download" flag and returns to step 500 to fetch another command. If it is not a "download-start" command, the system, in step 506, inquires into whether the command is a "Download-End" command. If it is, the command string is complete and in step 512, the system moves to the step "b" procedure in FIG. 5*b*. If it is not, in step 508, the system inquires into whether the download flag is raised. If it is, then the string has been completed (built) and the system moves to step 512 to send the command string to the interface. If it is not raised, this means that the command is an interface program command (e.g. apply voltage x at output "A" for y seconds command, or turn on (apply voltage x to turn light on at output B command, etc.), and in step 510 appends that command to the buffer and returns to step 500 to fetch another command.

Figure 5B:
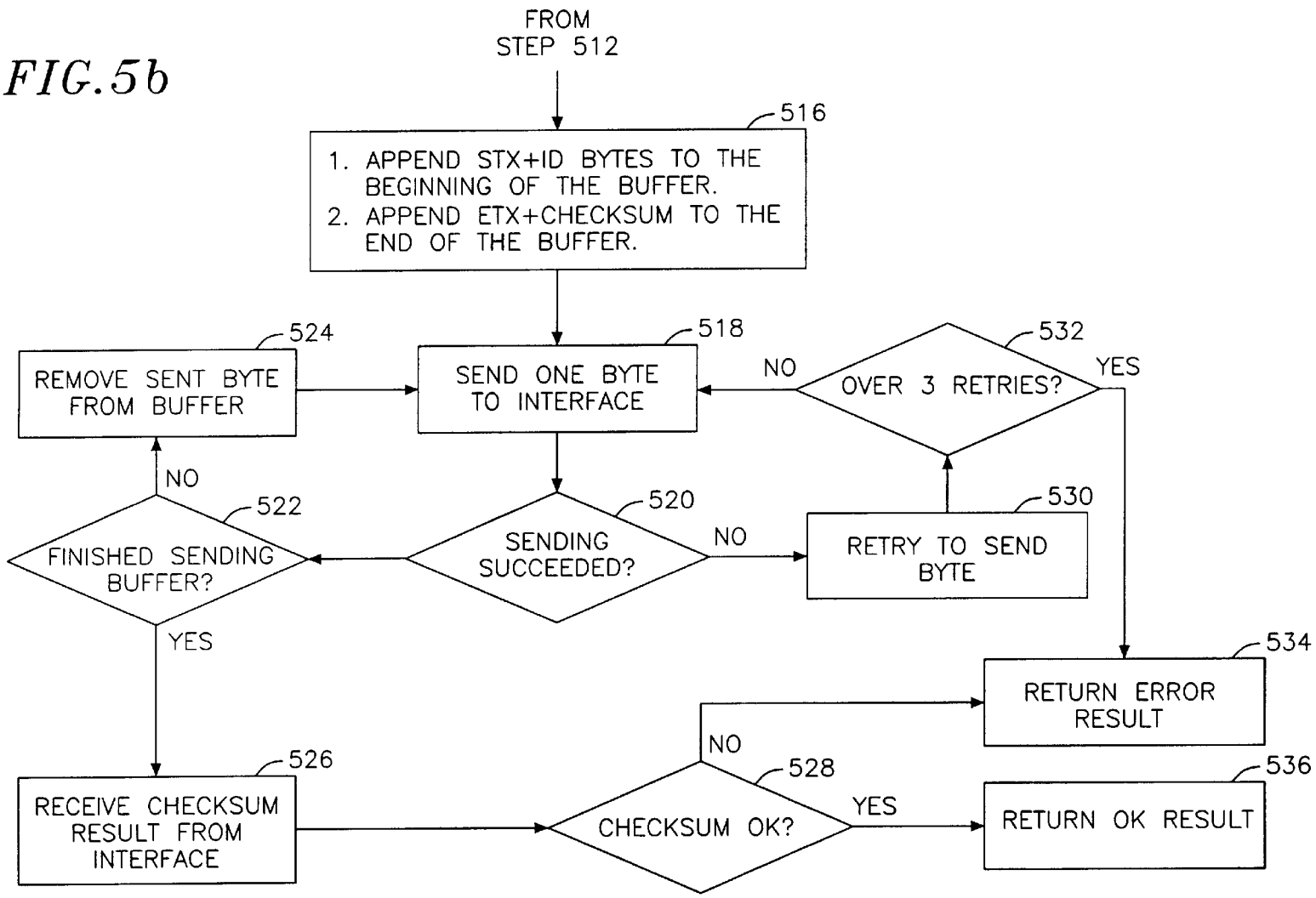
FIG. 5*b* is a flow chart depicting the method used by computer software of the present invention to transmit the command strings described in FIG. 5*a*.

Referring now to FIG. 5*b*, once in the send command mode, the system in step 516 appends two bytes to lead the string, namely a "start transmission" (STX) byte and an interface identification (ID) byte at the start of the command buffer, and two bytes at the end of the buffer, namely an "end transmission" (ETX) byte and a "checksum" (error check) byte. Note that the ID byte is determined by the current Interface ID the user has selected on the main graphical user interface screen on the computer. Then, at step 518, the computer transmits one byte to the interface and waits for an acknowledge answer from the interface (or until a period of time has elapsed) At step 520 the system determines whether the send was successful. The transmission is successful only when acknowledgment is returned by the Interface. Any other situation is regarded as failure. If so, in step 522 the system queries whether this was the last byte (i.e. whether the byte is an ETX command). If not, in step 524, the system prepares to transmit the next byte in the buffer and returns to step 518. If it is the last byte, the system moves to step 526, where it waits for a checksum result from the Interface, to validate the whole buffer which had just been sent. If the validation succeeds in step 528, this indicates that the command buffer successfully was sent to the appropriate interface and in step 536 the interface returns an "OK" result, thereby returning control of the computer system to the user for another command.

However, if at step 520, the first (or current) byte sent was not successful, in step 530 the system will attempt to send the byte again (back to step 518) only if an internal counter indicates in step 532 that three attempts have not been made. If however, three attempts have be made without success, on the next unsuccessful attempt, the system, via step 532, will not attempt to resend the byte again, but will instead return an error message to the main system (step 534), stop operating and return control back to the user.

Figure 6:
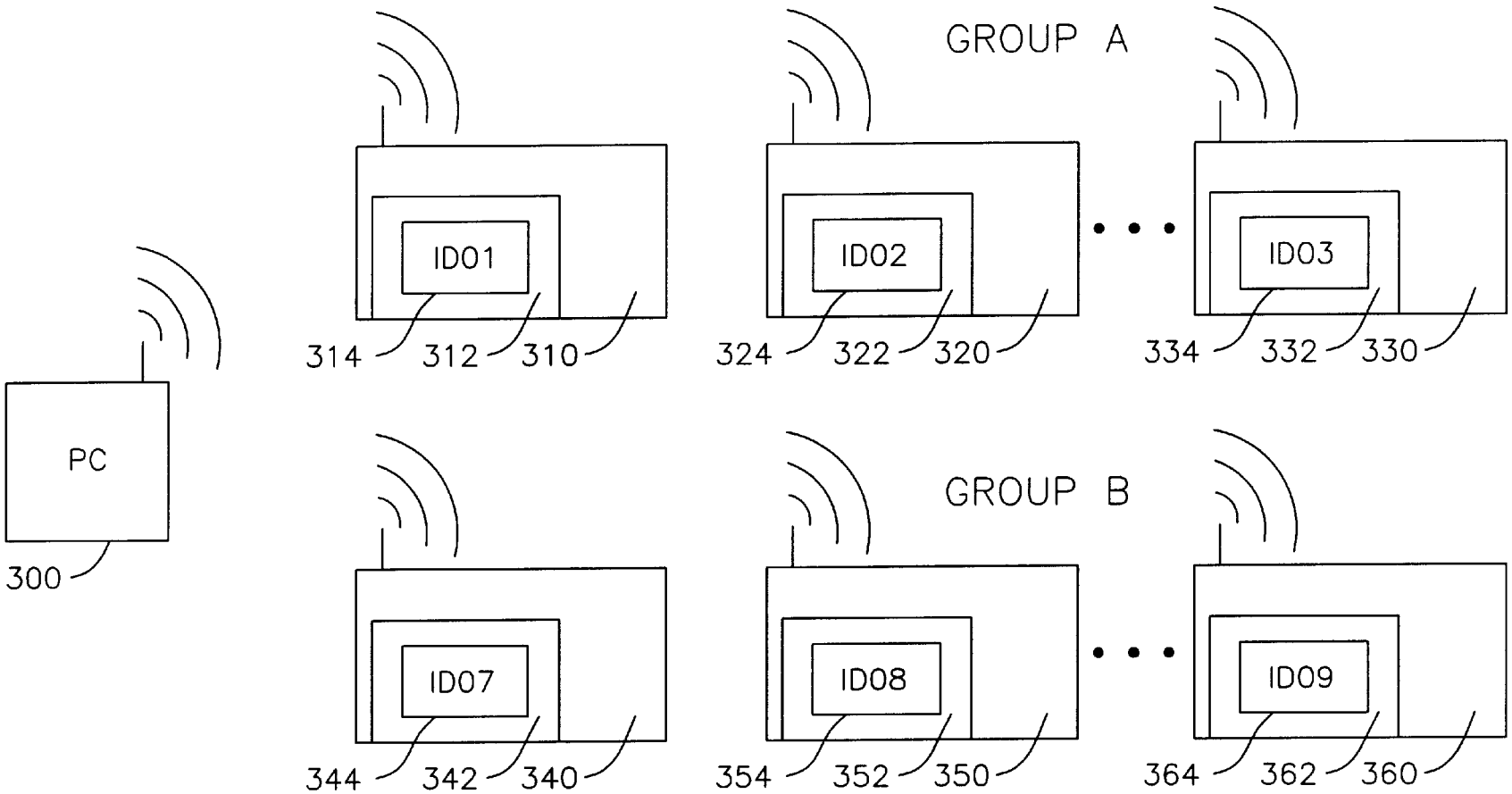
FIG. 6 is a simplified diagram showing a single computer in communication with one or more toy/interface units of the present invention (several inventive communication modes of practicing the present invention (broadcast and selective broadcast mode IFF)).

Referring now to FIG. 6, a schematic showing several toy units 310, 320, 330, 340, 350, and 360 with respective interfaces 312, 322, 332, 342, 352, and 362 which include a memory having respective identification data portions that store respective user-definable, interface identification data 314, 324, 334, 344, 354, and 364 specific to respective toy units, and a computer 300, loaded with the icon-based control programmer, in communication with each other, illustrates, by way of the following examples, several inventive aspects of the novel ID feature of the present invention.

EXAMPLE 1

Traffic Signal

Toy unit 310 is a simulated stop light having green, yellow and red lights that are electrically connected to output sockets A, B and C of its interface (not shown), respectively. Toy unit 320 is an automobile with one or more variable speed DC motors connected to its interface at output sockets A and B, and has identification code ID 02 324. With the computer 300, the programmer develops, and downloads to the memory of toy unit 310, a continuous-loop program, that directs power to be sent to output socket A to output a green (go) signal for 30 seconds, then to output socket B for a yellow (caution) signal for 5 seconds, then to output socket C for a red (stop) signal for 15 seconds, and then loops back to output A (green). This program continuously loops through these three steps as do many real life traffic signals. The program also instructs the interface 322 to communicate via RF with other toy units having ID code 02 to output a full power (high voltage for full motor speed) output at output sockets A and B of interfaces having ID code 02 when its own output A is activated (green light condition), a reduced power output (corresponding to a slow speed) at the remote interfaces' output sockets A and B when its own output B is activated (yellow light condition), and no output when its own output C is activated (red light condition).

The program may be downloaded to one of the six program locations, say as program number one, in the memory of the interface 312 of toy unit 310 having ID 01 314, and can be manually activated on the interface 312 or remotely activated by the computer 300. When the automobile/toy unit 320 having ID 02 324 is in range of RF reception from toy unit 310, it will move in accordance with the control signals transmitted by toy unit 310 to simulate a real traffic control and auto response environment.

EXAMPLE 2

Identify Friend/Foe (IFF)

In this example, there are two groups of programmable toy tanks, one friendly and the other the enemy, with each group "owning" its own set of secret ID codes. For example, each unit 310, 320 and 330 on team "A" has its own unique and secret ID code, say, 01 314, 02 324 and 03 334, unknown to the enemy side "B." Meanwhile each unit 340, 350 and 360 on side "B," has secret ID codes 07 344, 08 354 and 09 364, respectively. Once these similar looking tanks are mixed up in "battle," one command tank 310, having downloaded a particular control program from the computer 300, can send out a command signal to all friendly tanks n(320 and 330) to instruct them to work with it and against the other toys having IDs 07 344, 08 354, and 09 364. The command interface may instruct its "friends" to output some signal, such as to turn on a light, a motor, a sound output, or a return RF signal, to indicate they are "friends." Further, all units in Group "A" can send data they sense from the enemy environment, for instance, enemy tank movement (via, say, an infrared motion detector) or light emission, back to the command interface and computer for further processing.

EXAMPLE 3

Broadcast-To-All

Assuming that each unit was programmed with a different ID code, the system can operate in an "emergency" type broadcast to all mode. For example, the computer 300 or a command interface 312 can be programmed to send out a command signal (or execute a program either resident in the computer or in one of the six program memory locations of each interface) to every possible ID code, in series from 1 to 99 (or the limit), to take some action, such as move or output a light, etc.

In the "IFF" operating mode (Example 2 above), a further enhancement would be for each team to be able to control their group of tanks substantially simultaneously and in real time. For example, it would be desirable for team "A" to be able to control its army of tanks from one computer and team "B," in the same room, to control its tanks from its own computer. The same is true for the classroom environment, wherein many children may be learning to program and control multiple interfaces from multiple computers in one room and at the same time. However, since, in the preferred embodiment, the computer's transmit an RF signal at a predetermined wavelength, one computer's broadcast of data would interfere with another computer's simultaneous broadcast to another interface, thereby corrupting each other's signals. Thus, an additional feature of the subject invention, which enables multiple computers in the same transmission range, i.e. in the same room, to communicate with interfaces, entails the polling of the airwaves by each computer prepared to transmit, for the absence of any other RF signals, prior to transmission. In particular, immediately before transmitting data to a particular interface, the computer's RF modem/transceiver "listens" for other RF signals in the airwaves. If there are, it means that other computers or interfaces are communicating, and the computer enters into "standby and continue to listen" mode. Once it detects clear, or quiet, airwaves, the computer then transmits its data to the appropriate interface. It should be understood that the programming of this subroutine is within the skill of ordinary programmers. This feature greatly enhances the applications of the present invention.

It should be appreciated that many variations of the above can be conceived using the programmable ID features of the present invention, making such systems more interactive and fun and can create a demand for multiple toy unit systems for a single user. As seen, this system permits the complex control of one toy unit or the development of programmable and interactive teams or armies of toys.

Having thus described exemplary embodiments of the invention, it will be apparent that further alterations, modifications, and improvements will also occur to those skilled in the art. Further, it will be apparent that the present system is not limited to use with toy systems. Systems that can also be implemented by using the system and method described herein. Such alterations, modifications, and improvements, though not expressly described or mentioned above, are nonetheless intended and implied to be within the spirit and scope of the invention. Accordingly, the foregoing discussion is intended to be illustrative only; the invention is limited and defined only by the various following claims and equivalents thereto.

We claim:

1. A programmable toy interface for controlling a toy structure having at least one electrically-powered output device adapted to communicate with a computer having a programmable toy control and an identification program, the interface comprising:

a memory having an identification data portion that stores interface identification data specific to the toy structure;

a toy controller that executes the toy control program; and a power supply that supplies electrical power to the controller.

2. The interface of claim 1, further including a transceiver that receives signals from at least the computer and transmits those signals to at least one of the memory for storage and the controller for processing.

3. The interface of claim 2, wherein the transceiver is a radio frequency modem.

4. The interface of claim 1 further including a communications component for receiving signals generated by at least the computer, and transmitting those signals to at least one of the memory for storage, and the controller for processing.

5. The interface of claim 1, wherein the interface identification data is generated by the computer.

6. The interface of claim 1, wherein the interface identification data is generated by one of the computer and another programmable interface connected to another toy structure.

7. The interface of claim 2, wherein the interface is further adapted to communicate with one or more interfaces, each of the interfaces having a memory that stores unique, user-definable interface identification data, by addressing the interfaces by their stored identification data.

8. The interface of claim 7, wherein the memory further includes a program memory portion for storing therein at least one program or command for processing by the controller.

9. The interface of claim 8, wherein the interface is adapted to transmit a command or a program stored in the memory to a second interface for controlling the second interface.

10. The interface of claim 9, further including at least one input and input circuitry for electrically connecting thereto an input device connected to the toy structure.

11. The interface of claim 1, wherein the power supply is further adapted to selectively supply electrical power to the output device of the toy structure in response to a signal from the controller.

12. The interface of claim 11, further including at least one output capable of supplying a direct current voltage in the range of about 3 volts to about 12 volts.

13. A programmable toy entertainment system, comprising:

a first computer loaded with a control, program-development program which generates control and command signals and interface identification data; and a first addressable toy unit adapted to communicate with the computer, including (a) a first programmable toy interface having a transceiver for communicating with the computer, a controller that executes the control and command signals, a memory configured to store the interface identification data, wherein the interface identification data is specific to the first addressable toy unit, a power supply that supplies electrical power to the controller and transceiver, and at least one electric power-supplying, output port; and (b) a first toy structure electrically connected to the interface and capable of producing, in response to at least one output signal from the interface, at least one controlled electric power output.

14. The system of claim 13, further including a communications link that permits data transmission between the first computer and the first addressable toy.

15. The system of claim 13, wherein the first computer further includes a computer transceiver for communicating commands and data to and from the computer and the first interface further includes an interface transceiver.

16. The system of claim 13, wherein the communication link is wireless.

17. The system of claim 13, wherein the communication link is wired.

18. The system of claim 13, further including a second programmable toy unit with a second programmable toy interface having a second interface transceiver and that is adapted to communicate with the first interface and the first computer.

19. The system of claim 13, further including a second computer and a second addressable toy unit associated with the second computer, the second computer being loaded with a toy control, program-development, software program and adapted to output control and command signals and programs for controlling, programming and communicating with the first toy interface and for producing interface identification data specific to the second addressable toy unit for transmission to and storage by the second addressable toy unit;

wherein the first and second computers are adapted to communicate radio frequency commands without interference from each other.

20. A programmable toy interface for electrical connection with and control of a toy structure having at least one electrically-powered output device, and that is adapted to communicate with a computer having a programmable toy control and identification program, the interface comprising:

a memory having an identification code portion for storing an interface identification code specific to the toy structure and a program portion for storing at least one toy control program that is transmitted thereto by one of the computer and another programmable interface connected to another toy structure;

a radio frequency modem adapted to receive command and interface identification code signals from at least the computer and for transmitting data to at least one of the computer and a second interface;

a controller in communication with the memory and the modem for executing the toy control program, and further adapted to process data stored in the memory for transmission via the modem; and a power supply that supplies electrical power to the controller and for selectively supplying electrical output power in the range of 2 to 9 volts dc to the output device.

21. The interface of claim 1, wherein the interface identification data is user-definable.

22. The interface of claim 1, wherein the at least one electrically-powered output device is one of:

a motor, light, and a sound output.

23. The interface of claim 1, wherein the memory includes a memory location for storing the toy control program, and wherein the toy control program is downloaded to the toy control program memory location from the computer.

24. The interface of claim 1, wherein the interface includes a modem, and wherein the toy control program is transmitted by the computer to the interface modem and executed by the toy controller.

25. The interface of claim 1, wherein the toy controller receives user-definable commands.

26. The interface of claim 1, wherein the toy control program is based on icon-based programming, wherein an icon represents a preprogrammed toy control program.

27. The interface of claim 1, wherein the user-definable identification data comprises a numeric code.

28. The system of claim 13, wherein the interface identification data is user-definable.

29. The system of claim 13, wherein the at least one controlled electric power output is one of:

motion, light, and sound.

30. The system of claim 18, wherein the identification data enables exclusive communications between the first and second toy units.

31. The system of claim 30, including a plurality of toy units, wherein each of the plurality of toy units includes an interface and a transceiver, each toy unit being configured to communicate with each of the other of the plurality of toy units through respective transceivers, and each respective interface is identified with unique interface identification data.

32. The system of claim 31, wherein the unique, identification data distinguishes each toy unit from other toy units in the plurality of toy units.

33. The system of claim 31, wherein the unique interface identification data enables communications between two toy units of the plurality of units to the exclusion of other units.

34. The system of claim 31, wherein toy units with interfaces having selected interface identification data values are configured to communicate with each other to the exclusion of other toy units having interfaces associated with other interface identification data values.

35. The system of claim 31, wherein an interface of a selected toy unit broadcasts a command to interfaces of all other toy units of the plurality of toy units.

36. The system of claim 31, wherein multiple toy units with respective computers are within the same transmission range, wherein each computer is configured, prior to transmission, to poll airwaves within the transmission range for presence of signals from other computers.

37. The system of claim 36, wherein a computer, ready for transmission, detects signals from other computers and enters a standby mode before transmitting data to the respective interface.

38. The system or claim 36, wherein a computer, ready for transmission, detects an absence of signals from other computers and transmits data to the respective interface.

39. The interface of claim 20, wherein the interface identification data is programmer-definable.

40. The interface of claim 20, wherein the at least one electrically-powered output device is one of a motor, light, and a sound output.

* * * * *